US006092441A

United States Patent [19]

Jarvis

[11] Patent Number: 6,092,441

[45] **Date of Patent: *Jul. 25, 2000**

[54] MULTIPLE FITTING

[76] Inventor: Jack D. Jarvis, 3204 Periwinkle, Memphis, Tenn. 38127

[ * ] Notice: Under 35 U.S.C. 154(b), the term of this patent shall be extended for 381 days.

[21] Appl. No.: 08/731,857

[22] Filed: Oct. 21, 1996

Related U.S. Application Data

[63] Continuation-in-part of application No. 08/398,691, Mar. 6, 1995, abandoned, and a continuation-in-part of application No. 08/586,605, Jan. 16, 1996, abandoned.

[51] Int. Cl.[7] ..... B25B 13/00

[52] U.S. Cl. ..... 81/177.2; 81/177.75

[58] Field of Search ..... 81/177.2, 177.75, 81/177.85, 185

[56] References Cited

U.S. PATENT DOCUMENTS

| | | | |
|---|---|---|---|
| 1,775,402 | 9/1930 | Mandl | 81/177.75 |
| 4,114,401 | 9/1978 | Van Hoose | 81/177.75 |
| 4,936,701 | 6/1990 | Allen et al. | 81/177.75 |
| 5,168,782 | 12/1992 | Cromwell | 81/177.2 |
| 5,291,809 | 3/1994 | Fox, III et al. | 81/177.85 |
| 5,409,332 | 4/1995 | Chabot, Jr. et al. | 81/177.75 |
| 5,568,757 | 10/1996 | Lewis | 81/177.2 |

*Primary Examiner*—Willis Little
*Attorney, Agent, or Firm*—Paul M Denk

[57] ABSTRACT

An articulating adapter for use with a set of socket wrenches for connecting a socket to a socket drive. The adapter includes a first drive section having a square drive at one end and a skirt section at the other end. The skirt defines a cavity. There is a bias spring seated in the cavity and held in place by a pivot pin which extend across the mouth of the skirt section. The adapter includes a second drive section within the skirt of the first drive section. The second drive section has a square drive at one end and a substantially round base at opposite end. The round base is pivotally seated in the skirt cavity. The round base has a substantially oblong bore therethrough. The pivot pin extends through the bore to allow the second drive section to articulate approximately 360° within the skirt. The pivot pin, however, drives the adapter by engaging the sides of the bore when rotated. The square drive on the first drive section and the square drive on the second drive section are of different sizes so that the adapter can be used to step up from a smaller socket wrench drive or step down from a larger socket wrench drive. The square drives include spring-biased detents to secure a socket of adapter onto the square drive.

9 Claims, 2 Drawing Sheets

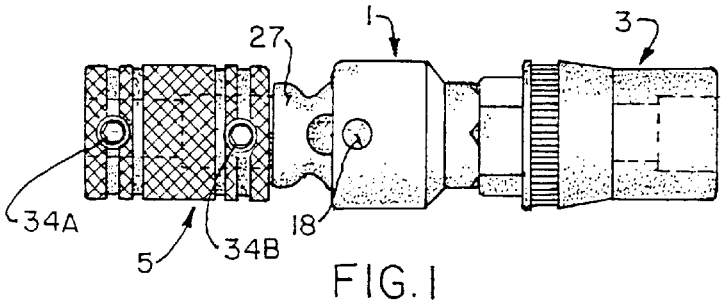
FIG. 1
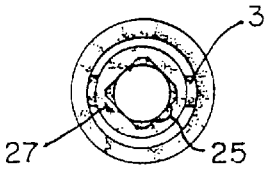
FIG. 3
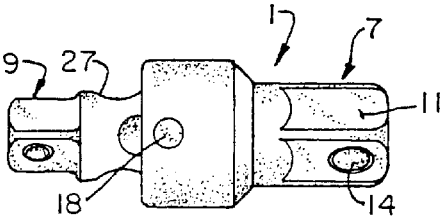
FIG. 2
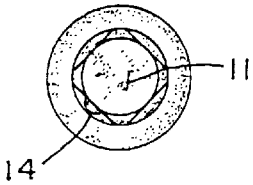
FIG. 4
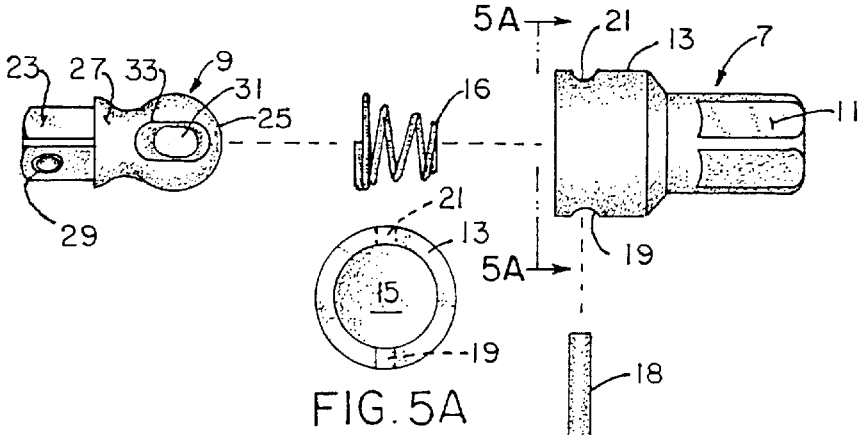
FIG. 5A
FIG. 5
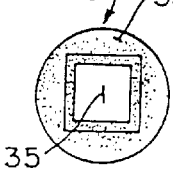
FIG. 6
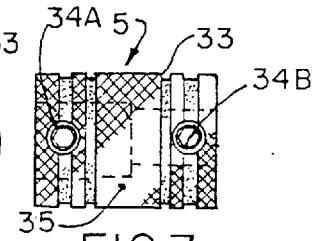
FIG. 7
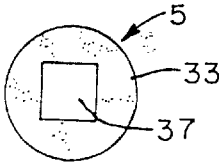
FIG. 8
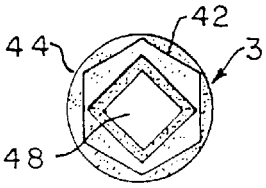
FIG. 9
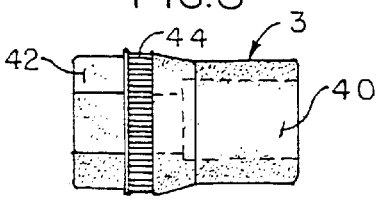
FIG. 10
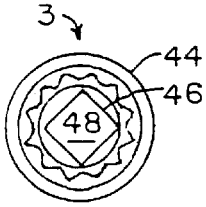
FIG. 11

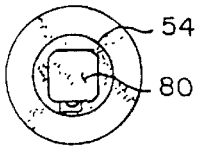
FIG.12
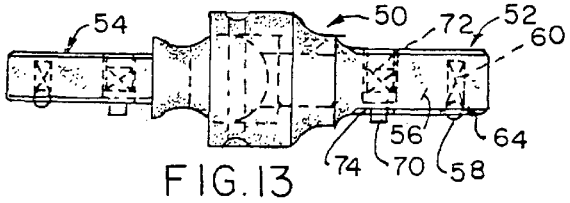
FIG.13
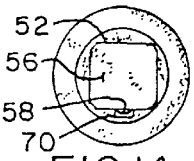
FIG.14
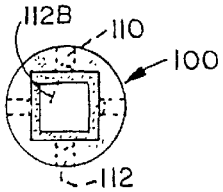
FIG. 15
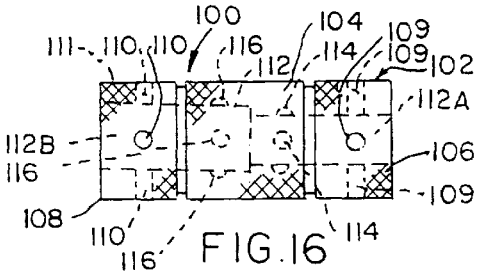
FIG.16
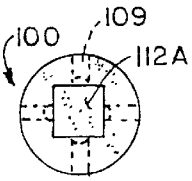
FIG.17
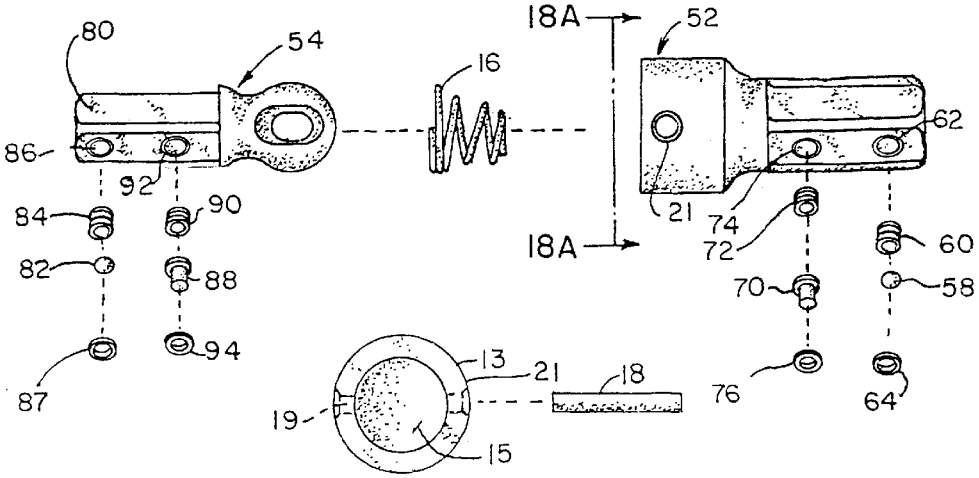
FIG. 18A
FIG.18

MULTIPLE FITTING

This application is a continuation-in-part of application Ser. No. 08/398,691 filed Mar. 6, 1995 now abandoned and a continuation-in-part of application Ser. No. 08/586,605, filed Jan. 16, 1996 now abandoned.

BACKGROUND OF THE INVENTION

This invention relates generally to hand tools and more specifically to an articulating multi-sized adapter.

Socket wrenches are known to the art. Generally, a socket wrench set has a number of interchangeable sockets that can be attached to a drive head which is integrally connected to a drive handle. The sockets are cylindrical in shape and have a rectangular opening at one end sized to fit a square drive on a socket drive head and a round, internally faceted workpiece engaging orifice at the other end. Typically, the workpiece is a nut or a bolt.

Generally speaking, the drive, as connected to a handle, has a square drive. The square drive engages the square opening in the socket. The rectangular opening of the socket is designed to mate with the square drive. For example, a socket designed to mate with a ¼ inch drive would have an ¼ inch rectangular opening. The sizes of the workpiece engaging orifices differ among the various interchangeable sockets so that the user can change sockets depending upon the size of the nut or bolt. The socket can range from ¼ inch to one inch or more. A larger drive allows for more torque to be applied on the wrench. Further, the drive handle of the wrench is heavier to accommodate a larger drive. A mechanic who does a variety of different jobs must have more than one set of socket wrenches. Generally the mechanic will have a set of ¼ inch drive sockets for lighter applications and a set of ½ inch or even a set of ¾ inch drive sockets for heavier applications. Of course, having a large inventory of wrenches increases overhead costs and requires extra storage space. Furthermore, if the mechanic is in the middle of a job and determines that he needs a different size socket set, he has to interrupt his work to get another set of wrenches.

In my co-pending application Ser. No. 08/398,691, I address these limitations by providing interchangeable sockets and drives that increase the versatility of a set of socket wrenches. Prior designs, including my own, however, do not address another problem encountered by the user. That is, often the user needs to apply a wrench to a workpiece at an odd angle. That is, the workpiece may be so positioned that a conventional socket wrench will not reach the workpiece. It would be useful, therefore, to have a adapter to attach between the drive and the socket that can articulate or bend so as to reach a workpiece in a difficult to reach place but that still retains its driving force. Moreover, it would be useful to have such a adapter that can accommodate different sizes of drives and sockets.

SUMMARY OF THE INVENTION

It is among the principal objects of the present invention to provide an articulating socket adapter that can accommodate different sizes of socket square drives and sockets.

Another object of the invention is to provide such an adapter that can step-up or step down the size of socket driven by a socket drive while retaining its articulating feature.

Still another object of the present invention is to provide such an adapter that has a articulating joint in the center and a first socket square drive at one end and a second socket square drive, of a different size, at the other end of the joint.

Yet another object of the present invention is provide such an adapter that can be used with variable sized sets of socket wrenches.

In accordance with the invention, generally stated, an articulating adapter for use with a set of socket wrenches for connecting a socket to a socket drive is provided. The adapter includes a first drive section having a square drive at one end and a skirt section at the other end. The skirt defines a cavity. There is a bias spring seated in the cavity and held in place by a pivot pin which extend across the mouth of the skirt section. The adapter includes a second drive section within the skirt of the first drive section. The second drive section has a square drive at one end and a substantially round base at opposite end. The round base is pivotally seated in the skirt cavity. The round base has a substantially oblong bore therethrough. The pivot pin extends through the bore to allow the second drive section to articulate approximately 360° within the skirt. The pivot pin, however, drives the adapter by engaging the sides of the bore when rotated. The square drive on the first drive section and the square drive on the second drive section are of different sizes so that the adapter can be used to step up from a smaller socket wrench drive or step down from a larger socket wrench drive.

BRIEF DESCRIPTION OF THE DRAWINGS

FIG. 1 is a side elevational view of the adapter of the present invention with a multi-sized straight adapter at one end and a socket attached at the other end;

FIG. 2 is a side elevational view of the adapter of the present invention, sans adapter and socket;

FIG. 3 is an end plan thereof;

FIG. 4 is another end plan of the end opposite that shown in FIG. 3;

FIG. 5 is an exploded view thereof;

FIG. 5A is an a view of the first drive end taken along line 5A—5A of FIG. 5;

FIG. 6 is an end plan of the multi-sized straight adapter;

FIG. 7 is a side elevational view thereof;

FIG. 8 is an end plan of the end opposite that shown in FIG. 6;

FIG. 9 is an end plan of the socket;

FIG. 10 is a side elevational view thereof;

FIG. 11 is an end plan of the end opposite that shown in FIG. 9;

FIG. 12 an end plan of another embodiment of the adapter of the present invention;

FIG. 13 is a side elevational view thereof;

FIG. 14 is a end plan of the opposite end thereof;

FIG. 15 is a end plan of another embodiment of a straight adapter;

FIG. 16 is a side elevational view thereof;

FIG. 17 is an end plan of the opposite end thereof;

FIG. 18 is an exploded view of the adapter of FIG. 13; and

FIG. 18A is an end view taken along line 18A—18A of FIG. 18.

DESCRIPTION OF THE PREFERRED EMBODIMENT

The articulating adapter of the present invention is indicated generally in the drawings by reference numeral 1.

Adapter 1 is shown in FIG. 1 having a socket 3 at one end and a straight, multi-sized adapter 5 at the other end. Socket 3 and straight adapter 5 will be described in greater detail below.

Articulating adapter 1, shown in greater detail in FIGS. 2–5, includes a first square drive section 7 and a second square drive section 9. First square drive section 7 includes a generally elongated square drive 11 at one end and a substantially cylindrical skirt 13 at the opposite end. The square drive 11 is a conventional square drive used to mount a conventional socket. Drive 11 includes a spring biased detent ball 14 in one side for securing the drive inside a square opening of a socket. There is a coil bias spring 16 seated in cavity 15. As seen in FIG. 5, spring 16 has a tapered profile so as to seat inside the cavity. A pivot pin 18 is inserted through openings 20, 21 in the skirt and retains spring 16 within the cavity and also functions to allow drive section 9 to articulate, as will now be described in greater detail.

Drive section 9 includes a square drive 23 and a substantially rounded base 25 with a flared, annular collar 27 between the square drive 23 and rounded base 27. Square drive 23 includes a spring-biased detent ball 29 in one side. Square drive 23 can engage a socket , as shown in FIG. 1, or the square opening in another adapter. Rounded base 25 is dimensioned to seat within cavity 15 and has an generally oval shaped bore 31 formed centrally therethrough. The outer edges 33 of the opening of the bore on each side of the base is flared out so that the opening defined by edge 33 is larger than the bore 31 itself. The previously described pin 18 is inserted through bore 31 to hold drive section 9 within the cavity. Bias spring 16 urges rounded base 25 outwardly urging the inner face of bore 31 against pin 18 thereby keeping drive section 9 from flopping around in the cavity.

The multi-sized adapter 5 is best seen in FIGS. 6–8. Adapter 5 includes a substantially cylindrical body 33. Body 33 includes a pair of set screws 34A and 34 B which protrude through body which can be turned with an Allen wrench or the like. The set screws 34B can be tightened in order to tightly attached the adapter to a square drive. Moreover, set screw 34A can be tightened to secure a square drive or other tool inserted into the opposite end of adapter 5. Body 33 has a knurled outer surface. Adapter 5 includes a substantially rectangular or square first opening 35 at one end and a second substantially square opening 37 at the opposite end. It will be appreciated that the openings 35 and 37 are of different dimensions. For example, opening 35 could be a ½ inch opening and opening 37 could be a ¼ inch opening. Thus, one end of the adapter can be attached to a ½ inch square drive and the other end can be attached to a ¼ inch square drive. If, for example, the user had a ¼ inch drive, he or she effectively could convert it to a ½ inch drive by using adapter 5. As shown in FIG. 1, adapter 5 is attached to drive section 9 of the articulating adapter 1. However, the larger opening 37 could be attached to drive section 9.

The socket 3 is shown in greater detail in FIGS. 9–11. As shown, socket three includes a cylindrical end 40 and a six-sided end 42. The end 42 allows for the application of a tool, such as a wrench, if needed. There is an externally knurled collar 44 between the two ends. The cylindrical end 40 includes a plurality of internal grooves 46 to facilitate the application of the socket to a workpiece, such as a nut or bolt. End 42 includes a square opening 48 for the introduction of a square drive. Opening 42 can be of any preferred dimension.

FIGS. 13 and 18 illustrate another embodiment of the articulating adapter of the present invention indicated generally by reference numeral 50. Adapter 50 is constructed in accordance with the principals described with reference to adapter 1. However, adapter 50 has a first square drive section 52 and a second square drive section 54. First square drive section 52 includes a generally elongated square drive 56. It will be appreciated that square drive 56 is substantially longer than the corresponding square drive 11 of adapter 1. Square drive 56 includes a detent ball 58 and bias spring 60 seated in bore 62 and held in the bore by retention ring 64. Detent ball 58 is position near the distal end of square drive 56. Square drive 56 also includes a T-shaped detent pin 70 and bias spring 72 seated in bore 74 and held in place by retention ring 76.

Drive section 54 includes an elongated square drive 80. It will be appreciated that square drive 80 is substantially longer that the corresponding square drive 23 of adapter 1. Square drive 80 includes a detent ball 82 and bias spring 84 seated in bore 86 formed in the distal end of square drive 80 and held in place by retention ring 87. Square drive 56 also includes a T-shaped detent pin 88 and bias spring 90 seated in bore 92 formed in the proximal end of square drive 56 and held in place by retention ring 94.

It will be appreciated that, for ease of illustration, the drawings and the accompanying drawings show the detent balls and detent pins of the square drives in alignment on the same side of the respective elongated square drives. However, the detent ball and detent pin of any square drive can be seated in bores formed in other facets of the square drive. That is, for example, a detent ball and detent pin could be position on opposite sides or adjacent sides of a given elongated square drive without departing from the scope of the invention.

It will be noted at this point that the elongated square drives 56 and 80 are of different dimensions. For example, square drive 56 can be a ½ inch drive while square drive 80 can be a ⅜ inch square drive. Of course, other combinations of sizes can be employed without departing from the scope of the invention.

FIGS. 15–17 illustrate a novel straight adapter, indicated generally by reference numeral 100, designed to be used with articulating adapter 50 of the present invention. Straight adapter 100 has an elongated, substantially tubular body 102 with a center section 104, a first end section 106 and a second or opposite end section 108. First end section includes at least one bore 109 formed through the wall. Second end section also has at least one bore 110 formed through the wall. The outer wall of body 102 has a knurled surface 111 to facilitate gripping and use. Body 102 also defines a longitudinal inner bore 112 having a first bore section 112A and a second bore section 112B. Bore 112 has a substantially square cross-section. Bore section 112A, which is within the first end section 106 and half of center section 104, is dimensioned to seat square drive 80. Thus, if square drive 80 is ⅜ inch drive, bore section 112A will snugly seat a ⅜ square drive. Bore section 112A has at least one indention 114 formed therein within the center section 104. When square drive 80 is inserted into bore section 112A, detent ball 82 seats in indention 114. Further, detent pin 88 seats in bore 109 to secure the square drive within the adapter. Bore section 112B, which is within second end section 108 and half of center section 104, is dimensioned to seat square drive 56. Thus, if square drive 56 is a ½ inch drive, bore section 112B will snugly seat a ½ inch square drive. Bore section 112 has at least one indention 116 formed therein within the center section 104. When square drive 54 is seated in bore section 112B, detent ball 58 seats in indention 116 and detent pin 70 seats in bore 110. To remove the respective detents pins from the respective bores, a small tool is used to push the pin against the bias spring to release the square drive from the adapter.

In use, the articulating adapter 1 of the present invention can be attached to a socket wrench drive by the use of a straight adapter 5 connected either at drive 7 or drive 9. A socket can be attached to the opposite end. The respective set screws 34A and 34B can be tightened to further secure the adapter. Articulating adapter 50 can be attached to an adapter 100 at either end. It will be appreciated by those skilled in the art that a number of combinations of sizes of sockets and adapters can be accommodated to increase the versatility of a set of socket wrenches. Moreover, articulating adapters 1 and 50 allows for flexure at the pivot point so that a socket can be applied to a hard to reach workpieces. The oval opening 33 allows for pivoting nearly 360° about the longitudinal axis of the adapter. However, rotation of the adapter by a square drive will cause a socket connected at either end to turn and thus manipulate a workpiece.

It will be appreciated that a number of changes and modifications could be made in the articulating adapter without departing from the scope of the appended claims. Therefore, the foregoing description and accompanying drawings are intended to be illustrative only and should not be construed in a limiting sense.

I claim:

1. An articulating adapter for connecting a socket to a square drive comprising:

a first drive section having a square drive at a first end and a skirt section at a second end, said skirt section defining a cavity;

a second drive section, said second drive section having a square drive at a first end and a rounded base section at a second end, said rounded base section being pivotally seated in said cavity;

a biasing spring within said cavity to exert an outward positioning force on said second drive section;

a pivot pin extending through said skirt and said rounded base section of said second drive section to pivotally retain said second drive section within said cavity;

said square drive of said first drive section has a detent means for the removable attachment of a socket or straight adapter, said square drive of said second drive section has a detent means for the removable attachment of a socket or straight adapter;

said square drive of the first drive section being of a different dimension than the square drive of said second drive section;

a socket for connecting to said articulating adapter;

a straight adapter for connecting to said articulating adapter;

each said socket and straight adapter having different sized openings at each of their opposite ends thereof;

wherein said articulating adapter may insert its square drives into one end of each of said socket and straight adapters, and upon reversing said articulating adapter its square drives fit within the different sized openings at the opposte ends of each socket and straight adapter.

2. The articulating adapter of claim 1 wherein the square drive of the first drive section also has a second detent means.

3. The articulating adapter of claim 1 wherein the square drive of the second drive section also has a second detent means.

4. The articulating adapter of claim 1 wherein the rounded base section of the second drive section having a pivot bore formed therethrough, said rounded base section being pivotally seated in said cavity;

said pivot pin extending through said skirt and said rounded base section of said second drive section to pivotally retain said second drive section within said cavity;

said pivot bore having a substantially oblong cross-section, said pivot bore having an outwardly flared edge defining said bore; and said elongated square drive of the first drive section includes first and second detent means, and said elongated square drive of said second drive section also includes a first and second detent means.

5. A multiple fitting connector for driveably connecting a firs size drive member to a first size driven member or a second size drive member to a second size driven member; said multiple fitting connector comprising:

(a) a first male drive member having an outer end with a male drive on said outer end sized to driveably engage the first size driven member;

(b) a second male drive member having an outer end with a male drive on said outer end sized to driveably engage the second size driven member;

(c) a joint driveably joining said first male drive member to said second male drive member so that rotation of one of said drive members will cause the other of said drive members to rotate; and (d) a female drive member driveably attached to one of said male drive members;

said female drive member having a first end and a second end;

said first end of said female drive member having a first female drive cavity sized to driveably receive either said male drive of said first male drive member or the first size driven member, said second end of said female drive cavity sized to driveably receive either said male drive of said second male drive member or the second size driven member.

6. The multiple fitting connector of claim 5 in which said joint includes means for allowing universal movement between said first and second drive members.

7. The multiple fitting connector of claim 5 in which each of said male drives of said male drive members has a square cross sectional shape; and in which each of said female drive cavities of said female drive member has a square cross-sectional shape.

8. A multiple fitting connector for driveably connecting a first drive member having a male drive of a first size to a first driven member having a female drive cavity of a first size, or for driveably connecting a second drive member having a male drive of a second size to a second driven member having a female drive cavity of a second size; sid multiple fitting connector comprising:

(a) a first male drive member having an outer end with a male drive on said outer end sized to driveably engage the female drive cavity of the first driven member;

(b) a second male drive member having an outer end with a male drive on said outer end sized to driveably engage the female drive cavity of the second driven member;

(c) universal joint means driveably joining said first male drive member to said second male drive member so that rotation of one of said first or second male drive members will cause the other of said first or second male drive members to rotate and for allowing universal movement between said first and second male drive members; and (d) a female drive member having a first end and a second end; said first end of said female drive member having a first female drive cavity sized to driveably receive either said male drive of said first male drive member or the female drive cavity of the first driven member; said second end of said female drive member having a second female drive cavity sized to driveably receive either said male drive of said second male drive member or the female drive cavity of the second driven member.

9. The multiple fitting connector of claim 8 in which each of said male drives of said male drive members has a square cross-sectional shape; and in which each of said female drive cavities of said female drive member has a square cross-sectional shape.

* * * * *